US010974368B2

(12) United States Patent
Guay

(10) Patent No.: US 10,974,368 B2
(45) Date of Patent: Apr. 13, 2021

(54) TABLE TENNIS ASSEMBLY TOOL

(71) Applicant: Todd Guay, Nashua, NH (US)

(72) Inventor: Todd Guay, Nashua, NH (US)

( * ) Notice: Subject to any disclaimer, the term of this patent is extended or adjusted under 35 U.S.C. 154(b) by 266 days.

(21) Appl. No.: 16/378,978

(22) Filed: Apr. 9, 2019

(65) Prior Publication Data

US 2020/0324394 A1 Oct. 15, 2020

(51) Int. Cl.

| | |
|---|---|
| ***B25B 5/12*** | (2006.01) |
| ***A63B 59/45*** | (2015.01) |
| *B25B 5/14* | (2006.01) |
| *A63B 102/16* | (2015.01) |

(52) U.S. Cl.

CPC ..... *B25B 5/12* (2013.01); *A63B 59/45* (2015.10); *A63B 2102/16* (2015.10); *B25B 5/14* (2013.01)

(58) Field of Classification Search

CPC ..... B25B 5/00; B25B 5/067; B25B 11/00; B25B 11/02; B23Q 3/00; B23Q 3/154; B23P 11/00; B23P 11/027; B23P 19/00; A63B 59/45

See application file for complete search history.

(56) References Cited

U.S. PATENT DOCUMENTS

| | | | | |
|---|---|---|---|---|
| 2,291,440 | A | 7/1942 | Andreef | |
| 3,879,250 | A | 4/1975 | Rankin, Jr. | |
| 3,930,920 | A | 1/1976 | Kicherer | |
| 4,062,541 | A | 12/1977 | Marks | |
| 4,183,776 | A | 1/1980 | Staub et al. | |
| 4,324,400 | A | 4/1982 | Tse | |
| 4,413,822 | A | 11/1983 | Fernandez et al. | |
| 5,139,258 | A | 8/1992 | McPoyle | |
| 5,234,657 | A * | 8/1993 | Hong | A63B 49/10 264/516 |
| 5,310,516 | A | 5/1994 | Shen | |
| 5,549,294 | A | 8/1996 | Wellen et al. | |
| 5,766,539 | A | 6/1998 | Fujita et al. | |
| 2003/0054907 | A1 | 3/2003 | Soo | |
| 2006/0160641 | A1 | 7/2006 | Mithieux | |
| 2007/0066425 | A1 | 3/2007 | Yoshihara et al. | |
| 2007/0191154 | A1 | 8/2007 | Genereux et al. | |
| 2020/0324394 | A1* | 10/2020 | Guay | A63B 59/45 |

* cited by examiner

*Primary Examiner* — Lee D Wilson

(74) *Attorney, Agent, or Firm* — Dunlap Bennett & Ludwig, PLLC

(57) ABSTRACT

A table tennis assembly apparatus is provided. The table tennis assembly apparatus may provide a base substrate and an overlaying cutting substrate. Along at least one peripheral of the base substrate may be a bar panel and or one or more clamps. Each clamp is for urging a first force distributor to sandwich a table tennis blade, in a uniform manner, against a glued table tennis rubber supported by the base substrate. After a predetermined amount of time a user may swap the first force distributor for a smaller second force distributor, enabling the user to trim the table tennis rubber around the perimeter of the blade.

8 Claims, 4 Drawing Sheets

TABLE TENNIS ASSEMBLY TOOL

BACKGROUND OF THE INVENTION

The present invention relates to table tennis paddle assembly methods and, more particularly, a table tennis assembly tool and method that focuses on both the cutting portion as well as the glue application and glue drying portion.

Assembly of a table tennis racket involves cutting and attaching with glue one or two sheets of rubber, normally red or black, to a table tennis blade. A sheet of the table tennis rubber, which had not been previously cut to the size of the head of the blade, is larger than the head of the table tennis blade. Affixing a sheet of rubber onto the table tennis blade involves selecting which side of the table tennis blade the rubber will be place on, gluing the table tennis rubber onto the selected side of the table tennis blade, and cutting the rubber sheets to the size of the table tennis blade's head. The assembler may choose to cut the rubber sheet prior to applying the glue or after the rubber sheet has been affixed to the blade because cutting the table tennis rubber may not be required if the rubber sheet had been previously affixed to the same or similarly sized table tennis blade. For table tennis blades which use two sheets of table tennis rubber, the process is repeated for the second rubber, which is attached to the other side of the table tennis blade.

In short, current table tennis assembly tools include table tennis rubber sheets cut by tracing the outline of the blade onto the rubber sheet, then using scissors or a knife to cut the rubber sheet to size. After the rubber sheet is cut to the appropriate size, the sheet would be glued, affixed to the blade, and optionally placed under books or some type of tool that would apply pressure during the glue drying process.

Other solutions in the table tennis assembly field require the table tennis rubber to be cut before the glue is applied to the rubber sheet. This can cause a number of problems. Mistakes in the tracing and cutting of the rubber sheet can ruin the fit of the rubber sheet on the blade. Cutting the rubber before applying the glue may also affect the fit because the size of some rubbers is affected by the glue drying process. Tools which attempt to solve this problem by assisting with the cutting of rubber sheets that have been affixed to the blade do not help with the drying process, so multiple tools would need to be used.

As can be seen, there is a need for a table tennis assembly apparatus and method of use that focuses on both the cutting portion as well as the glue application and glue drying portion. By applying and drying the glue on the blade before the rubber sheet has been cut, there is a better fit of the table tennis rubber onto the blade and a smaller chance of making a cutting mistake.

The table tennis racket assembly tool embodied by the present invention is used during the entire assembly process both cutting and affixing the rubber sheets to the blade. The glue can be applied before the sheet is cut. The tool provides pressure during the drying process. Once the rubber has been affixed and dried onto the blade, the tool assists with cutting the rubber sheet to the size of the blade. The tool is adjustable, so that it can be used to affix the table tennis rubber on both sides of table tennis blades which use two rubber sheets with proper drying pressure.

By applying and drying the glue on the blade before the rubber sheet has been cut, there is a better fit of the table tennis rubber onto the blade, resulting in a cleaner cut and less chance of making a mistake In sum, the table tennis racket assembly tool helps the table tennis racket assembler to affix the table tennis rubber to the blade and to cut the table tennis rubber to the side of the blade head.

SUMMARY OF THE INVENTION

In one aspect of the present invention, a method of attaching a rubber layer to a blade portion of a table tennis racket includes the following: providing the rubber layer, wherein the rubber layer is more than coextensive with the blade portion; providing a table tennis assembly apparatus having a base substrate; one or more clamps attached to the base substrate; and a first force distributor; applying an adhesive to a first surface the rubber layer; laying the rubber layer along an opposing second surface on the base substrate; sandwiching the blade portion against said first surface through urging the first force distributor by way of the one or more clamp; and trimming the rubber layer so as to be generally coextensive with the blade portion.

In another aspect of the present invention, a method of attaching a rubber layer to a blade portion of a table tennis racket including the following: providing the rubber layer, wherein the rubber layer is more than coextensive with the blade portion; providing a table tennis assembly apparatus having a base substrate a cutting substrate attached to the base substrate; one or more clamps attached to the base substrate; one or more side bar panel attached along a periphery of the base substrate; a first force distributor; a second force distributor, wherein the second force distributor is at least one-half in surface area of the first force distributor; applying an adhesive to a first surface the rubber layer; laying an opposing second surface of the rubber layer along the cutting substrate, wherein the blade portion is inward of the one or more side bar panel when sandwiching the blade portion; sandwiching the blade portion against said first surface through urging the first force distributor by way of the one or more clamp, wherein the base substrate is dimensioned so that an entirety of a handle of said table tennis racket extends beyond a periphery of the base substrate when sandwiching the blade portion; replacing the first distributor with the second distributor after said adhesive as dried; and trimming the rubber layer so as to be generally coextensive with the blade portion.

These and other features, aspects and advantages of the present invention will become better understood with reference to the following drawings, description and claims.

DETAILED DESCRIPTION OF THE INVENTION

Figure 1:
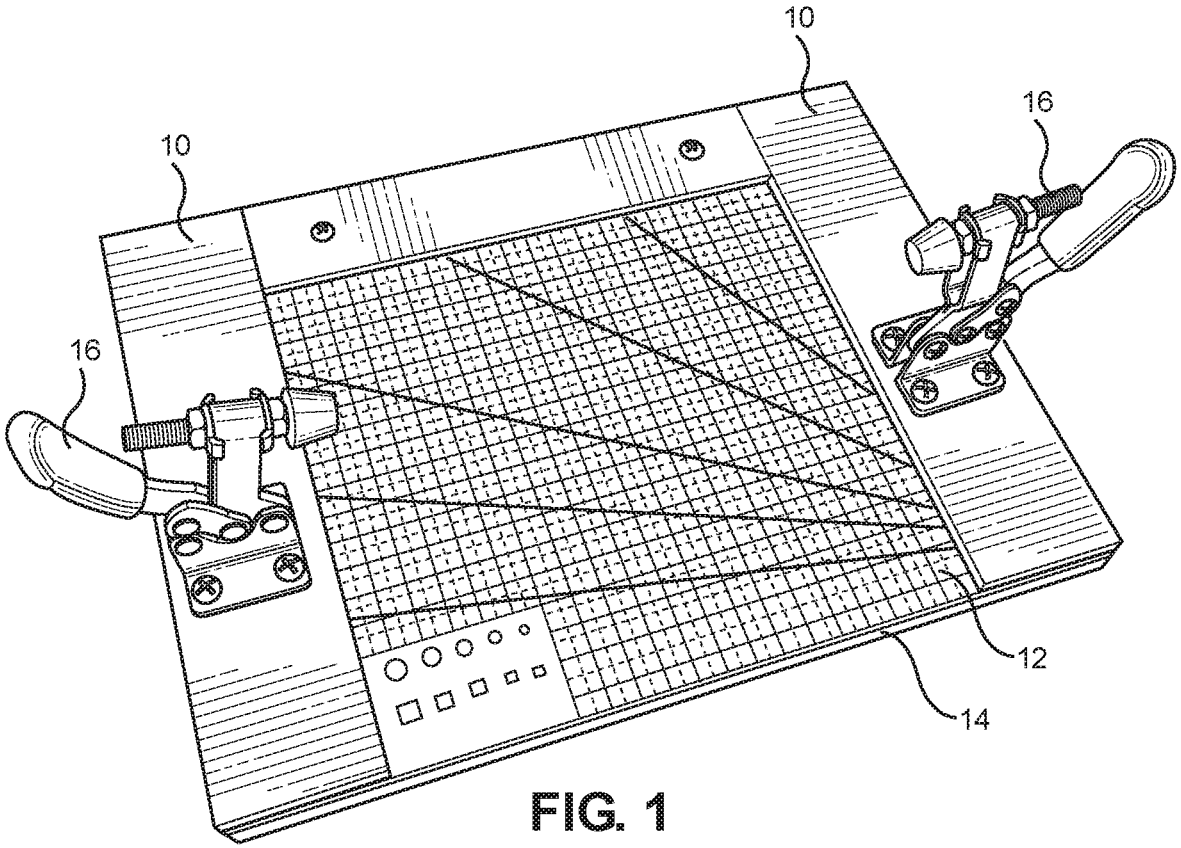
FIG. 1 is a perspective view of an exemplary embodiment of the present invention.
Figure 2:
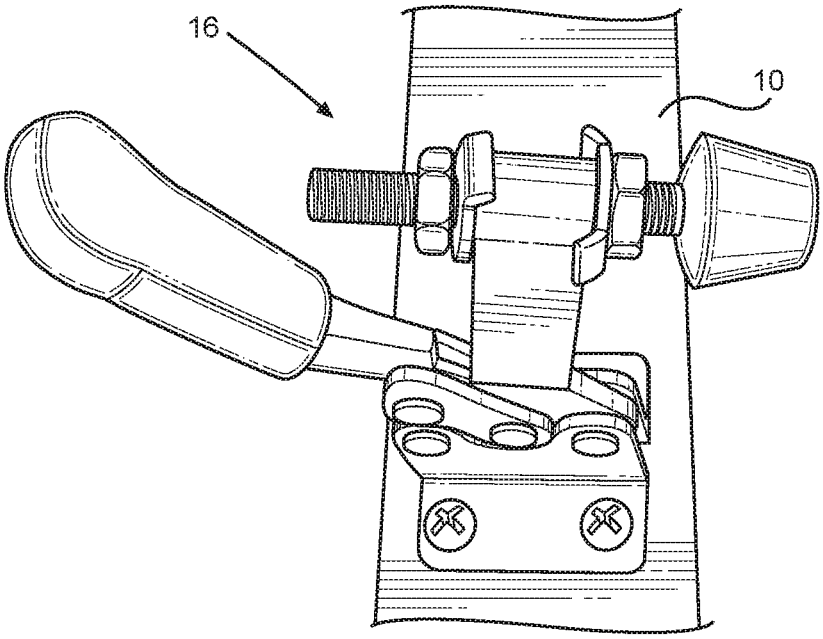
FIG. 2 is an enlarged perspective view of a clamp of an exemplary embodiment of the present invention.
Figure 3:
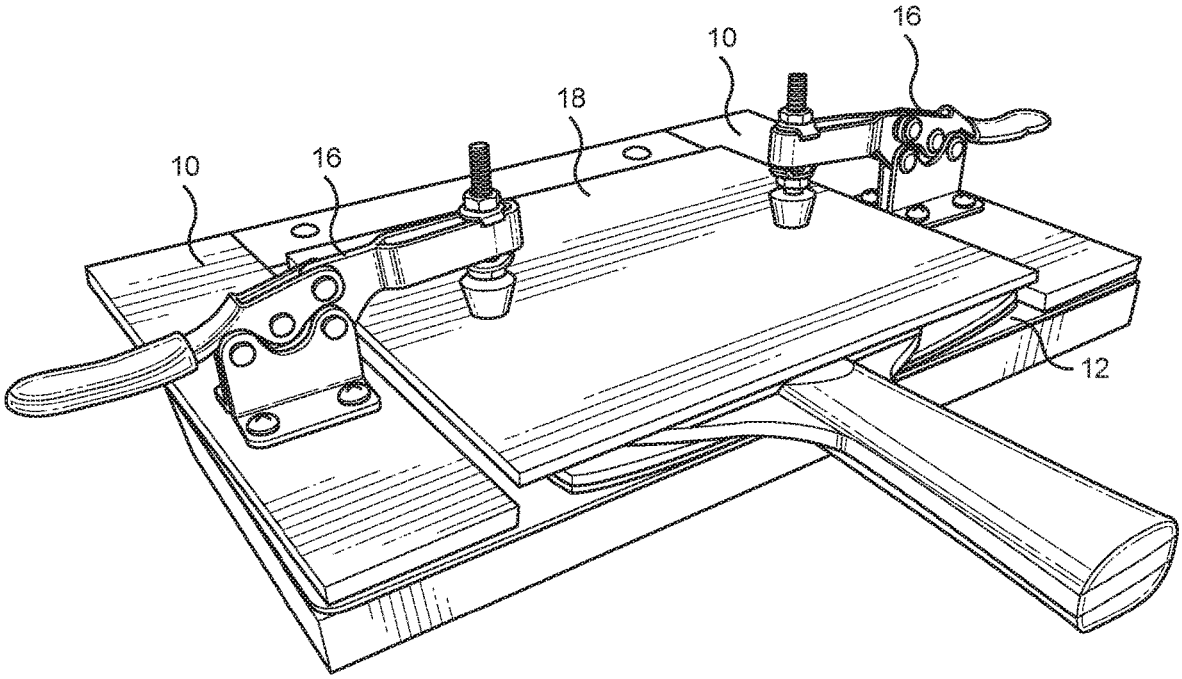
FIG. 3 is a perspective view of an exemplary embodiment of the present invention, shown in use.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, the present invention may include a table tennis assembly apparatus providing a base substrate and an overlaying cutting substrate. Along at least one peripheral of the base substrate may be a bar panel and or one or more clamps. Each clamp is for urging a first force distributor to sandwich a table tennis blade, in a uniform manner, against a glued table tennis rubber supported by the base substrate. After a predetermined amount of time a user may swap the first force distributor for a smaller second force distributor, enabling the user to trim the table tennis rubber around the perimeter of the blade.

Referring now to FIGS. 1 through 5, the present invention includes a table tennis assembly apparatus 100 providing a base substrate 14, a self-healing cutting substrate 12, a one or more bar panels 10, one or more clamps 16, and a force distributor 18. In certain embodiments, the base substrate 14 may measure 22 cm in height×30 cm in width and 2 cm in depth; the self-healing cutting substrate 12 measuring 22 cm in height×30 cm in width and 0.16 cm in depth; the one or more bar panels may be two opposing side bar panels generally rectangular in shape and having a 5 cm width and 0.5 cm depth as well as a top bar panel, also rectangular, measuring 3.8 cm in height×20 cm in width and 0.5 cm in depth; each clamp 16 may be a side-mount hold-down toggle clamps having a handle-open angle of 60 degrees, a bar-open angle or 85 degrees, and a holding capacity of 90 Kg/198 pounds; and the force distributor 18 may be rectangular and measuring 18.2 cm in height×20 cm in width and 0.5 cm in depth or measuring 15 cm in height×5 cm in width and 0.5 cm in depth. Most importantly, it should be understood that the above dimensions are approximates, as the dimensioning can vary as long as the present invention functions as disclosed herein.

Figure 4:
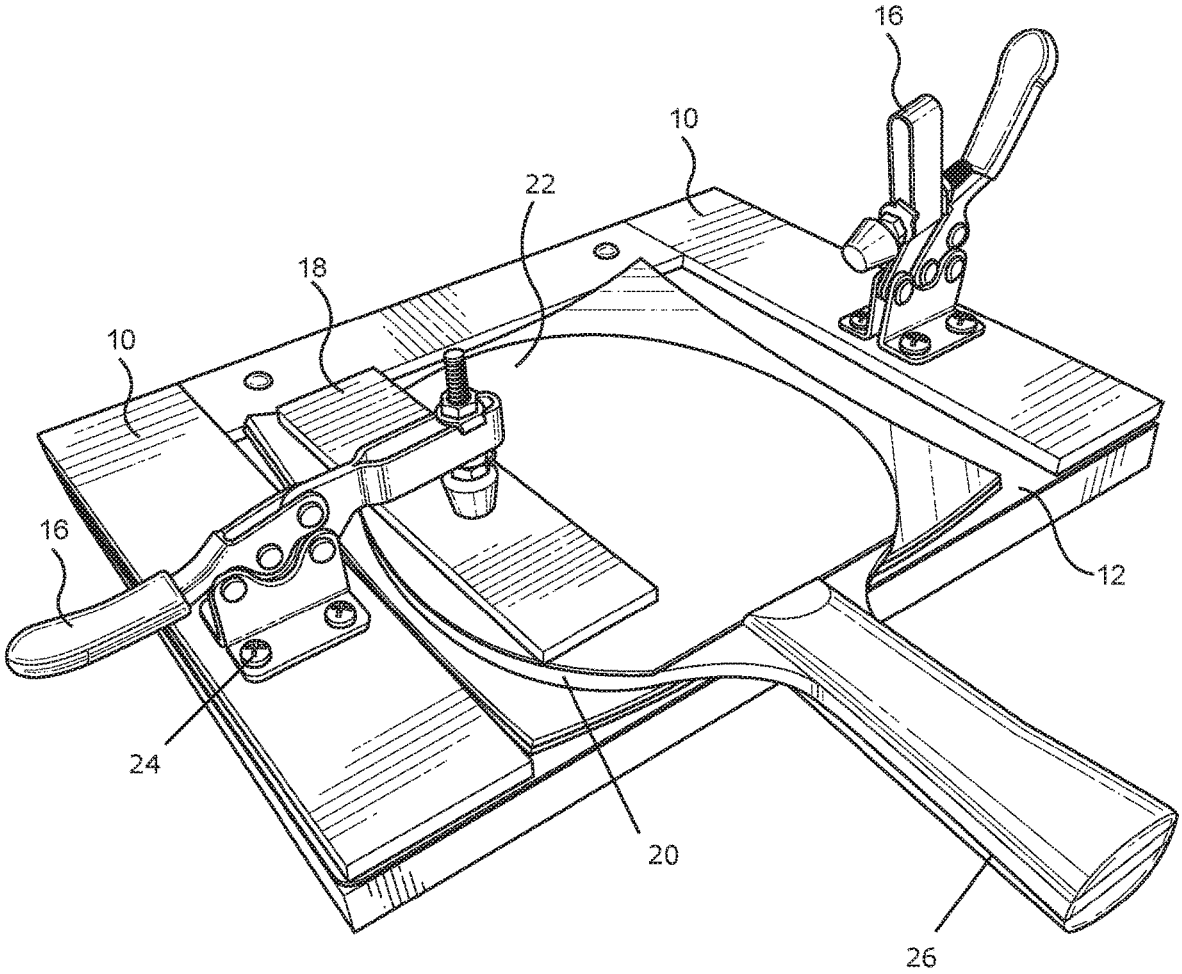
FIG. 4 is a perspective view of an exemplary embodiment of the present invention, shown in use.
Figure 5:
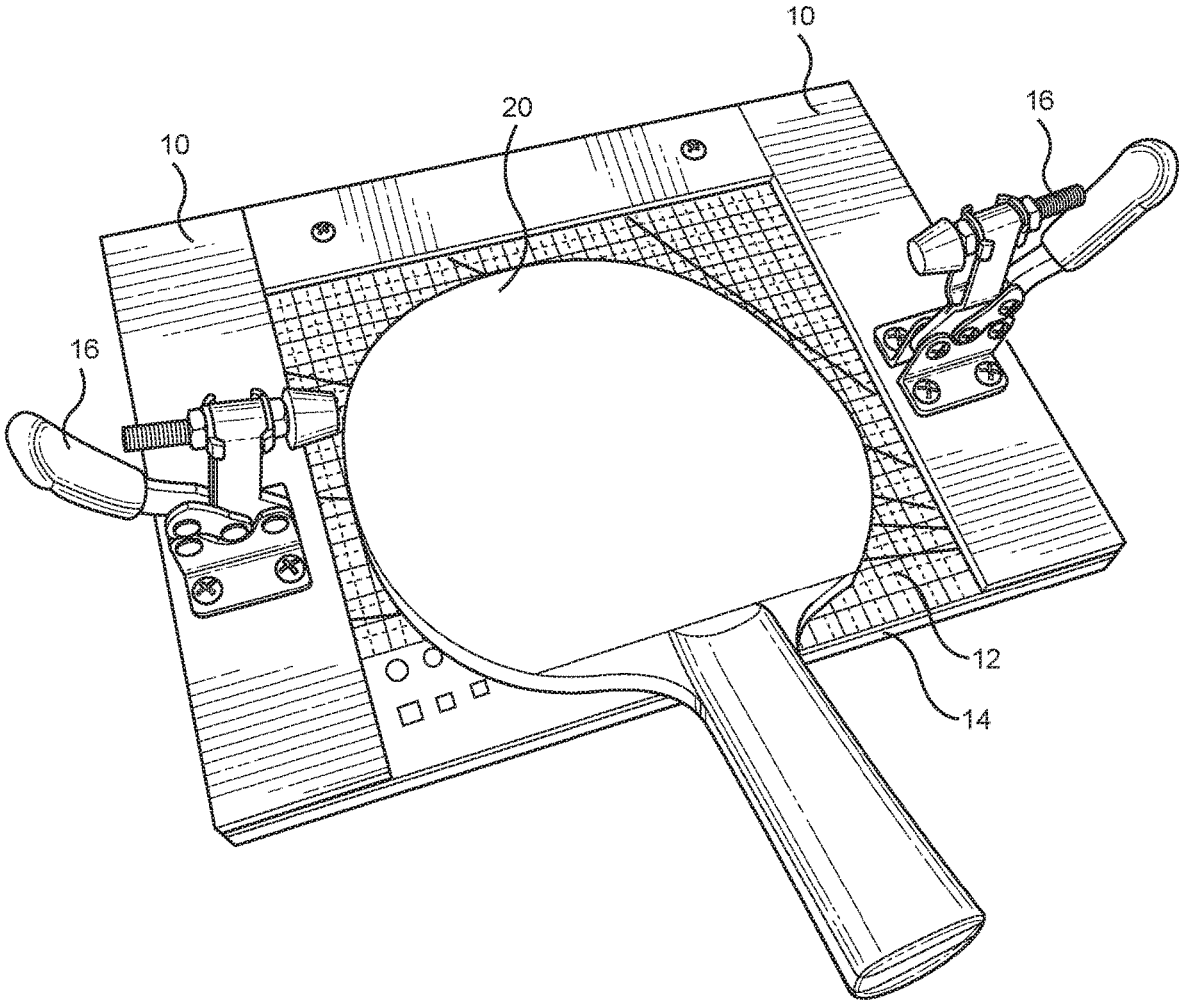
FIG. 5 is a perspective view of an exemplary embodiment of the present invention, shown in use.

A method of assembling the present invention may include the following. A user may attach the cutting substrate 12 to the base substrate 14 using an adhesive or other joining method. Then the user may attach the two side bar panels 10 on opposing ends (left and right), as illustrated in the Figures. In certain embodiments, the attachment may be made by drilling holes through the relevant side bar panel 10 and cutting substrate 12 and base substrate 14, and then using fasteners 24, such as screws and washers. Such fasteners 24 may simultaneous attach the clamps 16 to the side bar panel 10 through the respective side bar 10, as is illustrated in FIG. 4. Fastening holes in the base substrate 14 should be counter-sunk so that the fasteners 24 (e.g., nut and washer) do not protrude below the base substrate 14.

Once so assembled, the force distributors 18 may be placed between one or both clamps 16 and the table tennis rubber 22 or blade 20 to distribute the force of the clamping to avoid damage to the table tennis rubber 22 or blade 20. In one embodiment of the assembly apparatus 100, one force distributor 18 is approximately the size of a new sheet of table tennis rubber 22, and is typically used during the drying process, while a smaller force distributor 18 is provided to avoid damaging the table tennis rubber 22 or blade 20 during the cutting process.

A method of using the present invention may include the following. The assembly apparatus 100 disclosed above may be provided. A table tennis rubber sheet 22 may be placed on the upper surface of the cutting substrate 12 between the opposing side bars 10 and below the top side bar 10. Table tennis glue (not shown) is applied across the back surface of the rubber 22. The blade 20 may be placed on top of the table tennis rubber 22, so that the side of the blade 20 which is being attached is placed onto the side with the glue. The handle 26 of the table tennis racket protrudes from the side of the base substrate 14 which does not have a side or top bar 10. The larger force distributor 18 is placed on top of the racket surface that is not being glued. The clamps 16 fastened to the side bars 10 are lowered onto the force distributor 18. The clamp 16 may be adjusted to ensure that there is enough force to secure the racket onto the cutting substrate 12. Once the glue has dried, the clamps 16 are raised, and the smaller force distributor 18 may be used to secure the racket. The rubber sheet 22 that was glued is below the blade 20, with the rubber sheet 22 placed on the cutting substrate 12. The smaller force distributor 18 may be placed on top of the racket and the racket is secured to the cutting substrate 12 by the urging of the force distributor 18 down on the racket using one of the clamps 16. The rubber 22 on the side of the racket which is not clamped is cut to the size of the blade 20 using a suitable blade. The smaller force distributor 18 may be moved to the opposite clamp 16 when the force distributor 18 impedes the cutting progress along the edge of the blade 20. The racket is secured onto the other clamp 16 and the remainder of the rubber 22 may be cut along the edge of the blade 20. For table tennis rackets that have two playing surfaces, the process is repeated for the surface of the blade 20 that does not have an applied sheet of rubber 22. If the table tennis rubber 22 had already been cut to the size of the table tennis blade 20, the assembly apparatus 100 can be used to attach the sheet of rubber 22 to the blade 20. Table tennis glue may be applied across the back surface of the rubber 22. The blade 20 may be placed on top of the table tennis rubber 22, so that the side of the blade 20 which is being attached is placed onto the side with the glue and the edges of the rubber sheet align with the edges of the blade 20. The handle of the table tennis racket protrudes from the side of the platform which does not have a side or top bar 10. The rectangular force distributor 18 may be placed on top of the racket surface that is not being glued. The clamps 16 from the opposing side bars are lowered onto the force distributor 18. The clamp 16 may be adjusted to ensure that there is enough force to secure the racket onto the cutting substrate 12. The clamp 16 may be selectively adjusted to ensure that there is enough force to secure the racket 20 onto the cutting substrate 12. Once the glue has dried, the clamps 16 are raised and the completed racket can be removed.

The cutting substrate 12 is adapted to prevent damage to the base substrate 14 during the rubber cutting process. The opposing side bars 10 allow the assembly apparatus 100 to be used with thicker blades 20 and rubbers 22. Without them, very thick blades 20 may not be adjusted with the proper force when the rubber 22 is being glued onto the blade 20. The top bar 10 helps to ensure that a new rubber sheet 22 is aligned squarely onto the blade 20, while also having the benefit of securing the rectangular force distributor 18 on the base substrate when the assembly apparatus 100 is being stored. Two clamps 16 allows the force to be evenly distributed from both sides of the force distributor 18 during the glue drying process. The force distributors 18 help to prevent the force applied to secure the racket to the base substrate 14 from damaging the table tennis rubber 22 or the table tennis blade 20. Without the force distributors 18, round holes or marks may be seen in the rubber 22 or blade 20 after the clamps 16 have been removed from a previously secured racket. The cutting substrate may be made from self-healing material so as to be less likely to inflict damage the rubber sheets 22 over time. The base substrate 14 can be constructed of different materials, using a 3d printer or plastic molding, in a way that replaces the need for the separate cutting substrate 12 and/or the side bar panels 10.

It should be understood by those skilled in the art that the use of directional terms such as upper, lower, upward, downwardly, top and the like are used in relation to the illustrative embodiments as they are depicted in the figures, the upward direction (or upper) being toward the top of the corresponding figures and a downward direction being toward the bottom of the corresponding figures.

It should also be understood, of course, that the foregoing relates to exemplary embodiments of the invention and that modifications may be made without departing from the spirit and scope of the invention as set forth in the following claims.

What is claimed is:

1. A method of attaching a rubber layer to a blade portion of a table tennis racket, comprising:

providing the rubber layer, wherein the rubber layer is more than coextensive with the blade portion;

providing a table tennis assembly apparatus, comprising:

a base substrate;

one or more clamps attached to the base substrate; and a first force distributor;

applying an adhesive to a first surface the rubber layer;

laying the rubber layer along an opposing second surface on the base substrate;

sandwiching the blade portion against said first surface through urging the first force distributor by way of the one or more clamp; and trimming the rubber layer so as to be generally coextensive with the blade portion.

2. The method of claim 1, wherein the base substrate is dimensioned so that an entirety of a handle of said table tennis racket extends beyond a periphery of the base substrate when sandwiching the blade portion.

3. The method of claim 1, wherein the table tennis assembly apparatus further comprises one or more side bar panel attached along a periphery of the base substrate, and wherein the blade portion is inward of the one or more side bar panel when sandwiching the blade portion.

4. The method of claim 1, wherein the table tennis assembly apparatus further comprises a cutting substrate attached to the base substrate so that the cutting substrate is sandwiched between the blade portion and the base substrate.

5. The method of claim 1, further providing a second force distributor, wherein the second force distributor is up to one-half in surface area of the first force distributor, and replacing the first distributor with the second distributor prior to trimming the rubber layer.

6. The method of claim 1, wherein a surface area of the base substrate is 22 centimeters by 30 centimeters.

7. A method of attaching a rubber layer to a blade portion of a table tennis racket, comprising:

providing the rubber layer, wherein the rubber layer is more than coextensive with the blade portion;

providing a table tennis assembly apparatus, comprising:

a base substrate;

a cutting substrate attached to the base substrate;

one or more clamps attached to the base substrate;

one or more side bar panel attached along a periphery of the base substrate;

a first force distributor;

a second force distributor, wherein the second force distributor is up to one-half in surface area of the first force distributor applying an adhesive to a first surface the rubber layer;

laying an opposing second surface of the rubber layer along the cutting substrate, wherein the blade portion is inward of the one or more side bar panel when sandwiching the blade portion;

sandwiching the blade portion against said first surface through urging the first force distributor by way of the one or more clamp, wherein the base substrate is dimensioned so that an entirety of a handle of said table tennis racket extends beyond a periphery of the base substrate when sandwiching the blade portion;

replacing the first distributor with the second distributor after said adhesive as dried; and trimming the rubber layer so as to be generally coextensive with the blade portion.

8. The method of claim 7, wherein a surface area of the base substrate is 22 centimeters by 30 centimeters.

* * * * *